United States Patent [19]

Sakariason

[11] 4,029,247

[45] June 14, 1977

[54] STRIP FEEDING MECHANISM

[75] Inventor: Douglas M. Sakariason, Minneapolis, Minn.

[73] Assignee: Pako Corporation, Minneapolis, Minn.

[22] Filed: Aug. 25, 1975

[21] Appl. No.: 607,679

[52] U.S. Cl. ..... 226/43; 226/90

[51] Int. Cl.[2] ..... B65H 25/04

[58] Field of Search ..... 226/43, 44, 91, 90, 226/45

[56] References Cited

UNITED STATES PATENTS

| | | | |
|---|---|---|---|
| 1,263,419 | 4/1918 | James | 226/90 X |
| 2,314,070 | 3/1943 | Bogoslowsky | 226/43 X |
| 3,031,120 | 4/1962 | Chytil | 226/91 |
| 3,225,989 | 12/1965 | Stine | 226/44 |
| 3,804,312 | 4/1974 | Lagergren | 226/44 X |

*Primary Examiner*—Robert W. Saifer
*Attorney, Agent, or Firm*—John W. Adams

[57] ABSTRACT

A feeding mechanism for supplying elongated strips of material, such as photographic print paper and the like, in a tension-free state by use of a slack loop of said material, the size of which varies in response to the demands of a processing machine. Said loop actuates a switch for energizing and deenergizing a drive mechanism for supplying said loop from a supply roll so that the size of the slack loop directly controls the supply mechanism.

1 Claim, 1 Drawing Figure

STRIP FEEDING MECHANISM

It has long been a problem in strip processing machines to maintain a tension-free supply for the transport mechanism which moves the strip through the machine. The weight of the strip supply rolls varies with the size thereof and the resistance to withdrawal therefrom is not constant so that a constant tension on the portion of the strip being dispensed from the roll is difficult to maintain. Therefore, one solution to this problem is to maintain a tension-free slack loop of the strip material between the supply roll and the transport mechanism for moving the strip through the processing machine.

It is an object of this invention to provide a strip supply mechanism which provides a tension-free slack loop in the feeding path of the strip and which is adapted to remove the strip from the supply roll in response to reduction in size of said tension-free slack loop caused by the demand of the transport mechanism of said processing machine.

More specifically it is an object to provide a positive friction drive roller having a drive connection with its power source and including a control switch for energizing the power source in response to disengagement of a tension-free slack loop of said strip material caused by movement of the strip through the processing machine so as to maintain the length of said slack loop within a predetermined range.

These and other objects and advantages of this invention will be apparent from the following description made in connection with the accompanying drawing wherein like reference characters refer to similar parts throughout the several views, and in which.

Figures 1, 2:
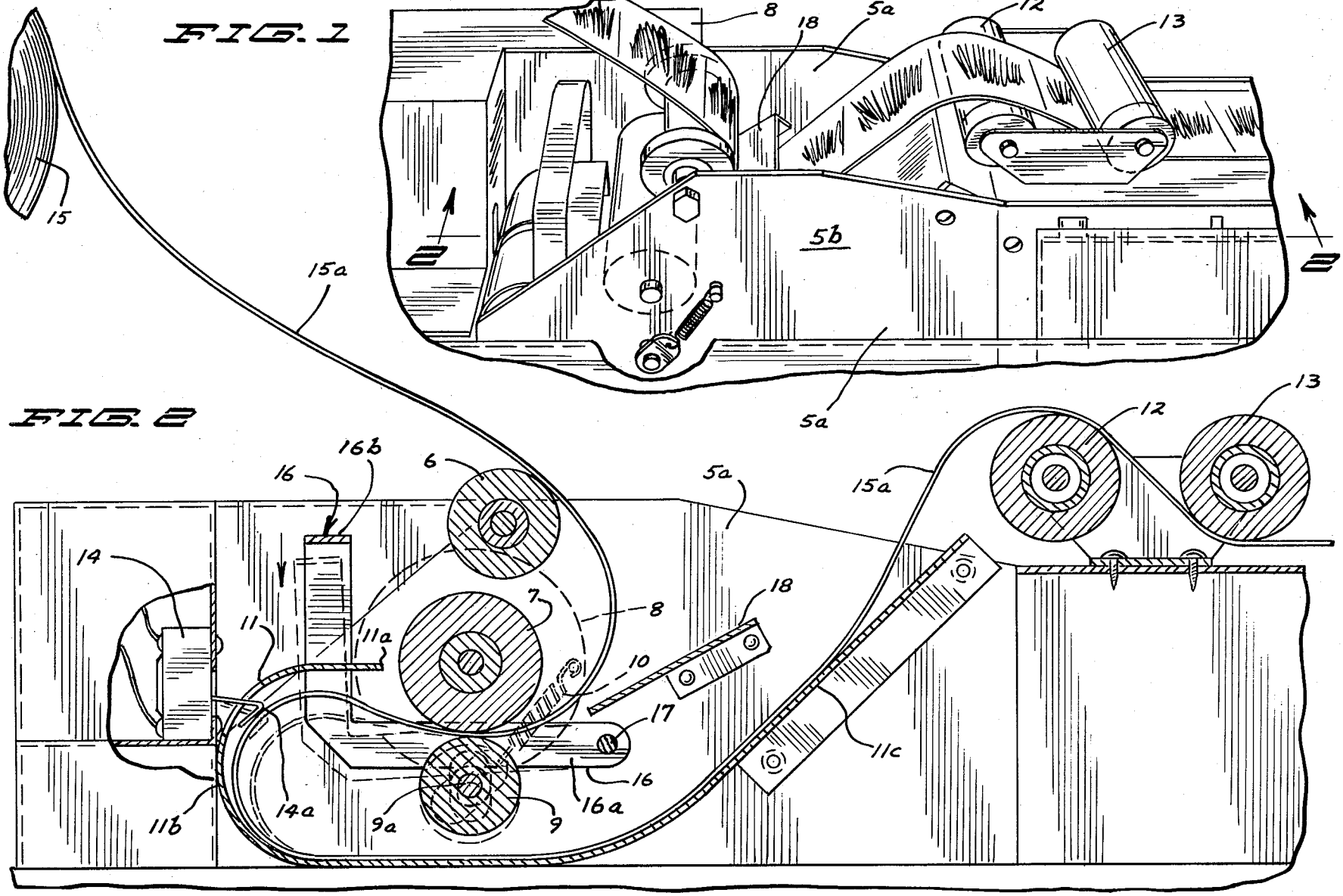
FIG. 1 is a perspective view showing a device embodying this invention.
FIG. 2 is a longitudinal vertical sectional view thereof.

As illustrated in the accompanying drawings, I provide a suitable support housing designated as an entirety by the numeral 5 and having a pair of spaced-apart longitudinal side panels 5*a* and 5*b*.

An upper guide roller 6 is journaled between the side panels 5*a* and 5*b* and a power driven drive feed roller 7 is rotatably mounted therebelow with a direct drive connection with a suitable power source, such as the electric motor 8. A pressure feed roller 9 is rotatably mounted in slots formed in said side panels 5*a* and 5*b* and pressure springs 10 on each side thereof resiliently urge the pressure roller 9 toward the power driven roller 7 and maintain frictional driving engagement with a strip interposed between said feed rollers 7 and 9.

Self-threading means are provided which comprises a curved guide panel or mold board 11 having a leading upper edge 11*a* disposed in close association to the downstream side of the feeding rollers 7 and 9, and intermediate loop forming portion 11*b* and a trailing portion forming a guiding extension 11*c*. A pair of guiding rollers 12 and 13 are positioned immediately downstream from the trailing end of extension 11*c* and immediately ahead of a transport mechanism (not shown) for moving the strip through the processing machine (also not shown). Said guide panel 11 provides a loop guide path downstream of the feed rollers 7 and 9, while a threading guide plate 18 is positioned in downwardly sloping relation on the upstream side of the feeding rollers 7 and 9 to initially guide the leading end of the strip 15*a* into said rollers and combines with said rollers and said guide path to produce self-threading of the strip into the transport mechanism of the processing machine.

A normally closed switch 14 is mounted at the curved portion 11*b* and has an actuator arm 14*a* which is spring-loaded into its downward position in which the switch 14 is closed. The switch 14, of course, is electrically connected to the motor 8 for controlling the operation thereof. A supply roll 15 is mounted on a suitable support spindle of conventional design (not shown) and dispenses the strip 15*a* material of to be processed.

Suitable means for retracting the pressure feed roller 9 downwardly away from the drive feed roller 7 to permit the strip to be initially fed between said rollers 7 and 9 is provided, such as the L shaped lever unit 16, having a pair of spaced lever arms 16*a* pivotally connected to the side panels 5*a* and 5*b* as by a pair of pivot pins 17. Said arms engage the ends of the mounting shaft 9*a* of the pressure roller 9 to permit downward force exerted on the upper horizontal cross member 16*b* of the lever arm unit 16 to retract said roller 9 into the dotted position shown in FIG. 2 to permit the strip to be straightened or released from the loop guide path.

In typical operation, the strip 15*a* is automatically threaded through said loop guide path by said self threading means. The leading end of said strip 15*a* is moved by the operator against threading guide plate 18 which directs said leading end between feed rollers 7 and 9. Since the strip 15*a* is not contacting switch actuator arm 14*a*, said rollers 7 and 9 are constantly rotating and thus drive strip 15*a* between them and along said downstream loop guide into said transporting mechanism. Said transporting path and mechanism feeds strip 15*a* into the processing machine until a sufficient quantity has been received and then ceases feeding the strip, causing a slack loop to build up by the driving rotation of rollers 7 and 9. When the slack loop is large enough to contact actuator arm 14*a* said arm 14*a* causes switch 14 to open and thus deenergize the motor 8 driving roller 7. Subsequently when said transporting mechanism has moved a length of the strip 15*a* through said processing machine and so diminished the slack loop that it no longer contacts the actuator arm 14*a*, switch 14 closes and motor 8 is energized to drive more of strip 15*a* into the loop guide path and replenish the slack loop until it again contacts arm 14*a* and deenergizes motor 8. Thus the length of the slack loop will be continuously maintained within a predetermined limit.

It will of course be understood that various changes may be made in the form, details, arrangement and proportions of the parts without departing from the scope of this invention as set forth in the appended claims.

What is claimed is:

1. A device for supplying a relatively stiff strip of photographic print paper from a roll in response to the demand of a machine for processing said strip comprising, a drive roller for withdrawing the strip of photographic print paper from the supply roll, a pressure roller for maintaining a positive driving connection between the strip and said drive roller, an electric motor connected to said drive roller, circuit means for supplying electric power to said motor, an electric switch in said circuit means for controlling the electric power to said motor, a generally U-shaped guide plate positively defining a loop guide path for said strip downstream from said drive roller to engage the strip from said drive roller and positively form a doubled back tension free slack loop downstream from drive roller, said plate having an opening therein, a loop sensing switch-actuating element extending through said plate opening and connected to said switch for controlling actuation thereof and mounted in said guide path for sensing the presence of said loop and positioned to close said switch when said loop becomes shorter than a predetermined length, and opening said switch when said loop becomes longer than a predetermined length, and means for receiving the tension free portion of the strip from said loop and guiding the portion into the machine for processing.

2. The apparatus set forth in claim 1 and said drive roller comprised of a high friction material.

3. The apparatus set forth in claim 2 and said means for maintaining a positive driving connection between the strip and said drive roller comprising a pressure roller positioned in generally opposed relation to said drive roller and resiliently urged towards the strip positioned between said drive and pressure rollers to maintain frictional drive contact of the strip by said drive roller.

4. The apparatus set forth in claim 3 and self-threading means comprising a threading guide plate positioned in downwardly sloping relation on the upstream side of said drive and pressure rollers to initially guide the leading end of the strip between said rollers and into said loop guide path.

5. The structure set forth in claim 3 and release means connected to said pressure roller for retracting the same against the resilient pressure applying force thereof and thereby permit the end of said strip to be initially fed through said loop guide path.

* * * * *